US012146480B2

(12) United States Patent
Casello et al.

(10) Patent No.: US 12,146,480 B2
(45) Date of Patent: Nov. 19, 2024

(54) CRYOPUMP

(71) Applicant: Edwards Vacuum LLC, Sanborn, NY (US)

(72) Inventors: John J. Casello, Chelmsford, MA (US); Paul K. Mahoney, Chelmsford, MA (US); Gerald M. Szarek, Chelmsford, MA (US)

(73) Assignee: Edwards Vacuum LLC, Sanborn, NY (US)

( * ) Notice: Subject to any disclaimer, the term of this patent is extended or adjusted under 35 U.S.C. 154(b) by 204 days.

(21) Appl. No.: 17/775,081

(22) PCT Filed: Nov. 6, 2020

(86) PCT No.: PCT/IB2020/060471
§ 371 (c)(1),
(2) Date: May 6, 2022

(87) PCT Pub. No.: WO2021/094886
PCT Pub. Date: May 20, 2021

(65) Prior Publication Data

US 2022/0389921 A1 Dec. 8, 2022

(30) Foreign Application Priority Data

Nov. 11, 2019 (GB) ..... 1916358

(51) Int. Cl.
*F04B 37/08* (2006.01)
*F04B 25/00* (2006.01)

(52) U.S. Cl.
CPC ..... *F04B 37/085* (2013.01); *F04B 25/00* (2013.01)

(58) Field of Classification Search
CPC ..... F04B 37/085; F04B 25/00; F04B 37/08; F04B 37/02; B01D 8/00
See application file for complete search history.

(56) References Cited

U.S. PATENT DOCUMENTS 4,718,241 A 1/1988 Lessard et al.
5,782,096 A 7/1998 Bartlett et al.
(Continued)

FOREIGN PATENT DOCUMENTS

CN 110291291 A 9/2019
JP 108219019 A 8/1996
(Continued)

OTHER PUBLICATIONS

PCT International Search Report dated Jan. 29, 2021 for corresponding PCT application Serial No. PCT/IB2020/060471, 3 pages.
(Continued)

*Primary Examiner* — Lionel Nouketcha
(74) *Attorney, Agent, or Firm* — Theodore M. Magee; Westman, Champlin & Koehler, P.A.

(57) ABSTRACT

A cryopump comprising: a vessel comprising a frontal open area, the frontal open area comprising an inlet to the vessel; a radiation shield; a two stage refrigerator extending into the vessel, a first stage of the refrigerator being thermally coupled to the radiation shield. A first stage array is arranged within the vessel and is also thermally coupled to the first stage of the refrigerator. A cryopanel structure is coupled to a second stage of the refrigerator. The first stage array comprises a plurality of elements arranged at increasing distances from the inlet, the element closest to the inlet being between the cryopanel structure and the inlet and elements further from the inlet having a passage through a central portion. The element closest to the inlet has a smaller outer perimeter than the elements further from the inlet.

15 Claims, 3 Drawing Sheets

(56) References Cited

U.S. PATENT DOCUMENTS

| | | | | |
|---|---|---|---|---|
| 2006/0064990 | A1 | 3/2006 | Bartlett et al. | |
| 2015/0159921 | A1 | 6/2015 | Lee et al. | |
| 2017/0009756 | A1 | 1/2017 | Wells | |
| 2017/0045043 | A1 * | 2/2017 | Yatsu | F25D 19/00 |

FOREIGN PATENT DOCUMENTS

| | | | | |
|---|---|---|---|---|
| JP | 2007327396 | A | 12/2007 | |
| WO | 2005005832 | A1 | 1/2005 | |
| WO | WO-2019099728 | A1 * | 5/2019 | B01D 8/00 |
| WO | 2020049915 | A1 | 3/2020 | |

OTHER PUBLICATIONS

PCT Written Opinion dated Jan. 29, 2021 for corresponding PCT application Serial No. PCT/IB2020/060471, 6 pages.
British Combined Search and Examination Report dated Apr. 24, 2020 and Search Report dated Apr. 23, 2020 for corresponding British application Serial No. GB1916358.3, 14 pages.
Search Report dated Sep. 29, 2020 for corresponding British application Serial No. GB1916358.3, 2 pages.
Chinese Office Action dated Feb. 28, 2024, for corresponding Chinese Application Serial No. CN202080078333.X, 14 pages.

* cited by examiner

CRYOPUMP

CROSS-REFERENCE TO RELATED APPLICATION

This application is a Section 371 National Stage Application of International Application No. PCT/IB2020/060471, filed Nov. 6, 2020, and published as WO 2021/094886 A1 on May 20, 2021, the content of which is hereby incorporated by reference in its entirety and which claims priority of British Application No. 1916358.3, filed Nov. 11, 2019.

FIELD

The field of the invention relates to cryopumps and in particular to two stage cryopumps having a first stage at a temperature for capturing type I gases such as water vapour, and a second stage at a lower temperature for capturing type II gases such as Nitrogen and in some embodiments to cryoadsorb type III gases such as hydrogen.

BACKGROUND

A two stage cryopump is formed of a low temperature second stage cryopanel array, operating in the range of 4-25 K, which may be coated with a capture material such as charcoal. This cryopanel array acts as the primary pumping surface and is surrounded by a first stage radiation shield that operates in the temperature range of 40-130 K, and provides radiation shielding to the lower temperature array and shields it from type I gases such as water vapour by capturing these gas molecules where they contact the shield.

The radiation shield is within the pump housing and is generally closed except for an inlet which is positioned between the cryopanel array and the chamber to be evacuated. This inlet is partially obscured by a first stage frontal cryopanel array which is thermally coupled to the radiation shield and serves as a pumping site for high boiling point type I gases such as water vapour.

In operation, when gases pass through the inlet into the pump vessel, at least some of the type I gases such as water vapour are condensed on the frontal array. The lower boiling point gases pass through the frontal array and into the volume within the radiation shield. Type II gases, such as nitrogen, condense on the second stage array, while type III gases, such as hydrogen, helium and neon which have appreciable vapour pressures at 4K are adsorbed by an adsorbent such as activated carbon, zeolite or a molecular sieve that coats the second stage cryopanels.

In this way gases entering the pump from the chamber are captured and a vacuum is generated within the pump vessel. One issue with cryopumps is that during operation their ability to capture gas molecules reduces as the capturing surfaces become saturated with gas molecules. Cryopumps are therefore regenerated periodically to release the captured gas molecules.

There are competing factors to consider when designing cryopumps, a high conductance of gas into the pump improves pumping speeds, however, it is advantageous to provide some shielding of the second stage cryopanels both from thermal radiation to reduce the thermal load on the cryopanels and from type I gases. Type I gases that reach the cryopanels condense on them blocking type III gases from being cryoadsorbed. Furthermore, some type I gases such as large chain hydrocarbons will not leave the array surface during a regeneration resulting in a reduction in pumping performance over the remaining life of the pump. Shielding of the cryopanels from gas molecules does however, result in a reduction in conductance.

WO2019/099728 discloses a two stage cryopump where some of these factors have been addressed with an igloo shaped frontal array providing shielding for the cryopanels.

It would be desirable to provide a two stage cryopump with a high conductance for type II and/or type III gases and yet with effective shielding of the second stage surfaces from type I gases.

The discussion above is merely provided for general background information and is not intended to be used as an aid in determining the scope of the claimed subject matter. The claimed subject matter is not limited to implementations that solve any or all disadvantages noted in the background.

SUMMARY

A first aspect provides a cryopump comprising: a vessel comprising a radiation shield having a frontal open area, said frontal open area comprising an inlet to said vessel; a two stage refrigerator extending into a side wall of said vessel at a portion of said side wall remote from said inlet, that is a point closer to a closed end of said vessel than to said inlet, a first stage of said refrigerator being thermally coupled to said radiation shield; a first stage array arranged within said vessel and thermally coupled to said first stage of said refrigerator; a cryopanel structure coupled to a second stage of said refrigerator; said first stage array comprising a plurality of elements arranged at increasing distances from said inlet, said element closest to said inlet being located between said inlet and said cryopanel structure and having a smaller outer perimeter than said elements further from said inlet, and said elements further from said inlet having a passage through a central portion.

The inventors recognised that there were competing demands on a cryopump, in that in order to effectively capture type II and/or III gases, these gases need to reach the cryopanels of the second stage with good conductance. However, these cryopanels needed to be effectively shielded both from thermal radiation and from type I gases in order to maintain an optimal second stage temperature for longer and to protect the cryopanels from becoming overloaded with type I gases which reduces their effectiveness. Conventionally a frontal array has been placed at the inlet to the pump to impede type I gases from reaching the cryopanels, such a conventional frontal array has apertures to allow gas molecules into the pump, these apertures being arranged in a chevron type arrangement. Gas molecules arriving at the inlet either travel directly through an aperture in the frontal array, are captured on the surface, deflected towards the radiation shield on the side wall of the pump where they are captured, or are deflected back towards the chamber being evacuated. One drawback of such an array is that there is a direct line of sight path for molecules travelling perpendicularly to the plane of the inlet through the frontal array towards the cryopanels for at least some of the surface area of the inlet such that type I gases with a suitable trajectory may travel directly to the cryopanels. Furthermore, the deflection of the gas molecules by the array at the inlet results in some of the type II and III gas molecules being deflected away from the pump inlet and not entering the pump and reaching the second stage array reducing their conductance and the pumping speed of the pump.

The inventors of the present invention have addressed these problems by forming the first stage array of multiple elements located at different distances from the inlet, and providing a barrier for at least some molecules travelling perpendicular to the plane of the inlet and a through path for some molecules that have a component parallel to the plane of the inlet, such as those deflected by the side walls.

Furthermore, the refrigerator is provided in the portion of the cryopump that is remote from the inlet which reduces the chances of gas molecules impacting the refrigerator element and being deflected back towards the inlet. This arrangement also stops the refrigerator element from shielding much of the upper portion of the cryopanel structure increasing the amount of area that is seen by the type II and III gases and increasing the uniformity of the capture of these gases by the cryopanel structure.

In this way effective targeted shielding is provided which protects the cryopanels from direct impact from type I gases while still allowing for high pumping speeds. In effect a first stage array that comprises elements that are at different distances from the inlet such that there are gas flow paths between them suitable for molecules reflected from the vessel's radiation shield, but line of sight paths are impeded is a better way to shield the second stage cryopanels and cryoadsorbing material while also allowing a high capture rate for hydrogen gas. Furthermore, providing the refrigerator remote from the inlet reduces unwanted shielding of the cryopanel structure from hydrogen gas.

It is these ideas working together that allow both effective shielding and increased speed. In some embodiments the pumping speed is able to be increased to more than 15,000 L/s hydrogen speed while still shielding the cryo adsorbing array from unwanted gases.

In some embodiments, said cryopanel structure has a diameter at a widest point that is less than 70% of a diameter of said vessel, preferably, less than 55%.

The cryopanel structure may be narrower than a conventional cryopanel structure and also longer. This increases the probability that gas molecules will reach the lower portions of the cryopanel structure and thereby improves the uniformity of molecules captured by the cryopanel structure increasing its effectiveness.

In some embodiments, said refrigerator extends into said vessel in a portion of said side wall that is at a distance of more than 60% of a length of said vessel from said inlet.

In order to improve gas conductance and to reduce the impedance to gas flow that the refrigerator extending into the vessel may provide, it is in the half of the vessel that is furthest from the inlet more preferably more than 60% into the vessel. More than 60% into the vessel is more than 60% along an axis that is perpendicular to a plane of the inlet and runs from the inlet to the base or closed end of the vessel. Providing the refrigerator element deep within the vessel reduces the chance of type II or type III particles hitting the refrigerator element being deflected out of the vessel or being deflected away from the cryopanels. Furthermore, it allows the first stage array to be mounted above the refrigerator element and the cryopanels to be mounted such that much of the structure is above the refrigerator and therefore not shielded by the refrigerator.

In some embodiments, said cryopanel structure has a length that is greater than 70% of a length of said vessel.

Providing a cryopanel structure that has a length that extends for much of the length of the pump vessel provides a large surface area for the particles to hit and be captured by, thereby improving the effectiveness and lifetime of the cryopanel structure between regenerations.

In some embodiments, said first stage array is mounted on a mounting element, said mounting element being formed of a thermally conducting material coupled to said first stage refrigerator and to each of said plurality of elements of said first stage array.

The first stage array is cooled to the temperature of the first stage of the refrigerator, which temperature is suitable for capturing type I gases. This cooling is effectively provided in some embodiments by mounting the first stage array in the vessel on a thermally conducting element which extends from the first stage of the refrigerator to each of the elements of the first stage array, thereby maintaining the array at or close to the temperature of the first stage refrigerator. In other embodiments, the first stage array may be mounted to the radiation shield which itself is thermally connected to the first stage refrigerator. In such an arrangement the first stage array may not be maintained as consistently close to the first stage refrigerator temperature as is the case when it is mounted on the thermally conducting mounting element.

The elements other than the element closest to the inlet have a passage through a central portion, in some cases they have an annular or ring-like form. The element closest to the inlet that is located between the cryopanel structure and the inlet does not have an annular form and may have a solid cross section and provide shielding of the cryopanel structure from the inlet, both from thermal radiation and from at least some gas molecules travelling directly towards the cryopanel structure from the inlet. Alternatively, it may have some apertures defining passages through the element, the apertures may be at least partially covered by a sloping flap type surface for deflecting molecules towards the side walls.

In some embodiments one end of said cryopanel structure extends into said first stage array, such that at least one of said elements further from said inlet surrounds an outer perimeter of said one end of said cryopanel structure.

Having a first stage array formed of a plurality of elements located at different distances from the inlet means that it is not a planar structure and this allows the cryopanel structure to extend into the array, resulting in increased shielding for that portion of the cryopanel structure. This is the portion of the cryopanel array that is closest to the inlet, and this portion is conventionally the portion that receives the highest proportion of gas molecules. Providing this portion with increased shielding compared to the portion of the cryopanel structure that is remote from the inlet allows the gas molecules to be captured in a more uniform manner along the length of the cryopanel structure.

In some embodiments, neighbouring elements of said first stage array are configured such that for at least some of said elements closest to said inlet an outer perimeter of one element is substantially equal to or smaller than an inner perimeter of a subsequent element located further from said pump inlet.

The arrangement of the elements may be such that the outer perimeter of one element is substantially the same as the inner perimeter of the subsequent element that is further from the inlet. Such an arrangement provides a substantially solid surface when viewed perpendicularly through the inlet, the substantially solid surface having the dimensions of the outer perimeter of the element furthest from the inlet. This provides a structure that is optically dense when viewed from the inlet and this is advantageous and provides effective shielding of the cryopanels. In effect the elements provide a substantially solid surface when viewed perpendicularly and where they are located within the pump at a distance from the inlet, they shield the cryopanels from further angles around the perpendicular when viewed from the inlet.

In this regard, the element of the first stage array that is closest to the inlet may be at a distance within the pump such that molecules hitting this surface are already past the pump inlet making it less likely that they are deflected back into the chamber that is being evacuated. In other embodiments, the element of the first stage array closest to the inlet may be located adjacent to the inlet.

In some embodiments, the outer perimeter of one element is slightly smaller than an inner perimeter of a subsequent element providing a gap for molecules traveling perpendicularly to the plane of the inlet. In such a case generally the difference between the inner and outer perimeter will be small, a difference in size of about 10% or less which allows a small number of molecules travelling perpendicularly to the inlet at the array to pass through the array.

Providing some gaps between elements when viewed perpendicularly increases conductance which is advantageous for the pumping of type III gases but has some disadvantageous effect for the contamination of the cryopanels with type I gases and for the heat load on the second stage which rises due to the decreased thermal shielding.

In some embodiments, said first stage array has a substantially igloo shape, said elements being concentric and said element closest to said inlet having a smallest perimeter, and a plurality of subsequent elements having outer perimeters of an increasing size with distance from said inlet.

The first stage array may have a substantially igloo shaped with increasing sizes of concentric elements. In some cases the elements may increase in size from the element closest to the inlet to the element furthest from the inlet, while in other embodiments the elements closest to the inlet may increase in size and at a certain point elements with the same size may be used.

In some embodiments, said elements are substantially planar said element closest to said inlet comprises a disc and subsequent elements comprise rings.

Although the elements may have a number of forms, and may for example have an angular perimeter, it may be advantageous for them to be comprised of disks and rings. This provides symmetry across the cross section and is particularly advantageous where the radiation shield has a substantially cylindrical form.

In some embodiments the disc has a solid cross section, while in other embodiments the disc has some apertures providing some through passages through the disk. These apertures may be at least partially obscured by slanting surfaces arranged to deflect molecules hitting them towards the radiation shield.

In some embodiments, said surfaces of said elements facing said inlet are at an angle of between 0° and 30° to a plane of said inlet, such that they are parallel to said plane or slanted such that a surface closest to said inlet faces towards said radiation shield. In some embodiments, where some of the elements are angled, the element closest to the inlet may be at an angle of 0° and the further elements may be slanted.

In some cases it may be advantageous to slant the surfaces of the element such that the particles impacting the surface are deflected towards the radiation shield, in other embodiments, the surface of the element facing the inlet are substantially parallel to a plane of the inlet. The slanting of the elements provides better shielding of the cryopanel structure but reduces conductance, thus, it depends on the requirements of the pump whether flat or slightly slanted elements may be preferred. In any case, as the first stage array is within the pump, even flat elements deflecting perpendicularly may still retain perpendicularly arriving molecules within the pump as such deflected molecules may hit other molecules before reaching the inlet.

In some embodiments, said element of said first stage array that is furthest from said inlet is mounted closest to said first stage of said refrigerator, said element of said first stage array closest to said inlet being between 5 and 15% into said vessel.

In some embodiments, said first stage array extends from a point between 5 and 15% into said vessel to a point between 25 and 40%.

As noted previously, the first stage array is not a planar array but rather extends longitudinally within the pump, in some cases along a length of 10 to 35% of the length of the vessel. The longitudinal extent of the array provides effective shielding of the cryopanel structure along a substantial portion of its lengths leading to more uniform distribution of captured molecules on the surfaces of the cryopanel structure.

In some embodiments, said cryopanel structure comprises a plurality of panels extending out from a central axis and having a substantially cylindrical envelope with at least one tapered end, one of said at least one tapered end extending into said first stage inlet array.

Although the cryopanel structure may have a number of forms, a convenient form is one with plurality of panels extending out from the central axis the envelope of the structure having a substantially cylindrical shape that matches but is smaller than the shape of the cylindrical radiation shield. The structure may have at least one tapered end that extends into the first stage array and in some embodiments both ends may be tapered.

Such a one-piece structure has several cryopanels, which where type III gases such as hydrogen are to be captured has adsorption material such as charcoal on both sides. Such a structure allows the number of panels to be changed depending on the type II or III gas speed and capacity needed for a particular application providing a flexible design which can be optimised for particular applications. For some implant applications the number of panels will depend on the hydrogen speed and capacity.

In some embodiments, a portion of said cryopanel structure that extends into said first stage array comprises at least 20%, preferably at least 30% of said cryopanel structure.

In some embodiments, said radiation shield is substantially cylindrical and comprises a flattened portion extending into said cylinder for coupling to said refrigerator, said flattened portion extending into said cylinder by less than 8% of a diameter of said cylinder, preferably less than 6%.

The radiation shield is cylindrical and thus, to couple the shield to the flange of the refrigerator in cases where the flange is flat, the radiation shield has a flattened portion corresponding to the shape of the flange that extends into the vessel. This leads to a protruding surface extending from the radiation shield above the refrigerator element. This provides a surface for gases to hit and be deflected back towards the inlet. The inventors recognised the potential problem with this arrangement and provided a design where the flattened portion was kept as small as feasible for a good connection, so that the extension of this portion into the cylinder and thus, the size of the protruding surface were also reduced, thereby improving conductance.

The refrigerator extends into a portion of said cryopanel structure that is furthest from said inlet.

Mounting the cryopanel structure on the refrigerator such that the refrigerator extends into the cryopanel structure at a point that is remote from the inlet reduces the likelihood that the refrigerator structure will be impacted by gas molecules.

Furthermore, as much of the cryopanel structure is above the refrigerator, a substantial length of the structure is not shielded by the refrigerator at all and this improves conductance. The refrigerator extends into the half of the cryopanel structure that is furthest from the inlet.

In some embodiments the cryopanels are coated in carbon for adsorbing some type III gases such as hydrogen.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The summary is provided to introduce a selection of concepts in a simplified form that are further described in the detailed description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Figure 1:
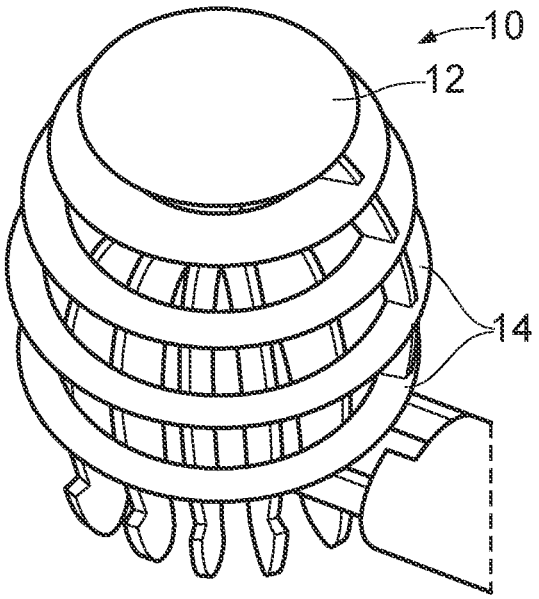
FIG. 1 shows a first stage array according to an embodiment.

Before discussing the embodiments in any more detail, first an overview will be provided.

The requirements for cryopumps are becoming more challenging as new implant processes are developed and more consistent vacuum environments are needed to keep up with process vacuum conditions.

The inventors recognised that cryopump array geometry is critical to improving the vacuum conditions provided by cryogenic vacuum pumps. Taking "Implant" processes for example where cryopumps are often used to generate the high vacuums required and hydrogen is the major gas constituent, and contamination from photoresist is a major issue, embodiments extend the contamination resistance and increase the hydrogen pumping speed by providing one or more of three main design improvements.

1.) Cryopanel optimization; The geometry of the 2nd stage array has been redesigned, providing an array with a longer and narrower profile than the conventional array leading to enhanced hydrogen pumping. The $2^{nd}$ stage array panel is protected from exposure to gaseous contamination and radiation with an "Igloo" first stage array. In effect the cryopanel structure and igloo array are geometrically designed to complement each other such that they act together to improve type III gas conductance while also increasing thermal and type I gas shielding.

2.) The geometric design of the first stage or "Igloo" inlet baffle provides increased hydrogen performance and superior resistance to gaseous contamination of the second stage array.

3.) Refrigerator location; The refrigerator is strategically lowered in the vessel compared to conventional designs to permit better gas conductance, creating a longer array pumping path with fewer first strike contamination strikes. The refrigerator penetration in addition to being lower in the vessel also has a smaller cross section to improve conductance.

The above design changes seek to increase type III gas pumping speed in particular, and to limit second stage array contamination, lower second stage radiant load and lower first stage or Igloo array temperatures, these all make for a more stable vacuum pump.

The refrigerator location closer to the bottom of the vessel is one aspect to the pump overall performance providing:

1.) Better conductance—there is less interruption to the type II and type III gases such as hydrogen entering the pump and more can reach the cryopanels.

2.) It allows the 2nd stage cryopanel/mount to be a one-piece design. The symmetry of the cryopanels improves the type II/III gas pumping uniformity over the entire cryopanel surface. This uniformity is crucial to the type II/III speed and capacity, keeping all panels available to pump these gases more evenly so as not to overwhelm any panels with the gases. When cryopanels become locally saturated because of non-uniformity of their design this renders these panels unavailable to more incoming molecules. This provides an unbalanced pumping condition causing the remaining cryopanels to get higher loading and the cryopump pressure rise to be quicker than expected resulting in a rapid reduction in pumping speed for type III gases.

3.) The refrigerator cylinder being lower in the pump also works with the enhanced Igloo inlet array to shield the cryopanels from unwanted radiation and from most first strike photoresist contamination. The inlet array design is mounted on a thermally conducting element extending from the first stage of the refrigerator enabling the array to be maintained at a colder temperature than a typical inlet array configuration that is connected to the radiation shield.

FIG. 1 shows an igloo style first stage array 10 according to an embodiment. The array is formed of a plurality of elements 12, 14 that are arranged at increasing distances from an inlet to the pump. The element that is closest to the pump is disc 12 and further elements 14 of increasing size are placed at increasing distances from the inlet to the pump. This igloo style inlet baffle or array is mounted via a thermally conductive member 36 (see FIG. 2) on the first stage of the refrigerating element. This thermally conductive member allows the igloo to be maintained at a temperature that is close to that of the first stage refrigerating element, reduces hot spots on the igloo surfaces and allows the surfaces to be retained at a reduced temperature and thereby provides improved capture for type I gases. The radiation shield also experiences lower temperatures when compared to a radiation shield coupled to a conventional first stage array extending across the inlet and thus, it too may have improved capture for type I gases. In this embodiment, disc 12 is a solid disc, in other embodiments disc 12 may have apertures within the disc to allow passage of some molecules. In some cases, these apertures may be shielded to some extent by flaps extending partially across the apertures and slanted to deflect molecules towards the radiation shield.

Figure 2:
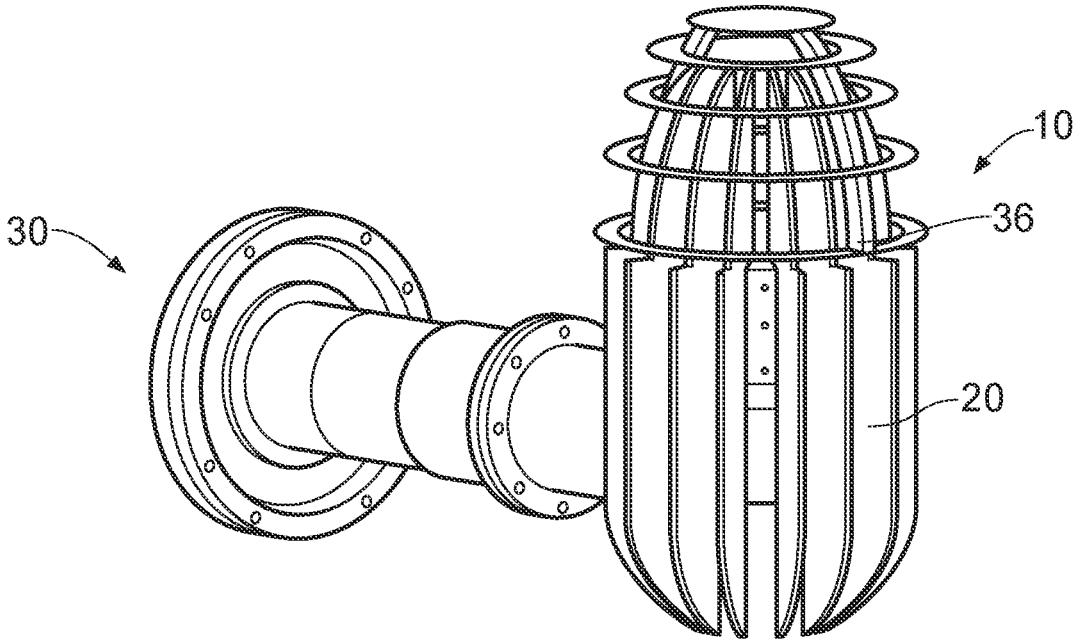
FIG. 2 shows a second stage cryopanel structure mounted on a refrigerator element and extending into a first stage array according to an embodiment.

FIG. 2 shows the first stage array 10 coupled to the refrigerator element 30 which extends into a side wall of the pump vessel and supports the second stage cryopanel structure 20. The second stage cryopanel structure 20 extends up into the first stage array 10 such that the elements of the first stage array 10 surround the portion of the second stage cryopanel structure 20 that is closest to the inlet. This provides improved shielding of this portion of the cryopanel structure and reduces the probability of gas molecules contacting the higher portions and improves the uniformity of capture of molecules along the length of the cryopanel structure thereby increasing the lifetime and effectiveness of the cryopanel structure.

The refrigerator element 30 extends into the vessel and comprises a first stage refrigerator element at the first stage temperature and this is coupled to the first stage array 10 via a thermally conductive mount 36 allowing for the first stage array to be maintained at or close to the temperature of the first stage refrigerator element in a uniform and effective manner. The thermally conductive mount 36 extends around the first stage array contacting each element in two places and providing effective cooling for this array.

The second stage cryopanel structure is mounted to the second stage refrigerator element and is thus, cooled to the temperatures of the second stage. The refrigerator element 30 extends into the lower portion of the pump vessel remote from the inlet and supports the lower half of the cryopanel structure such that this support does not obscure the upper half of the cryopanel structure from the gas molecules entering the pump. This again leads to better distribution of gas molecules over the cryopanel structure.

The cryopanel structure 20 is longer and thinner than conventional cryopanel structures and this improves conductance and type II and type III gas capture uniformity allowing better access to the lower portions of the cryopanels. Furthermore, the refrigerator position being lowered relative to the pump inlet also improves conductance and increases pumping speed.

Figure 3:
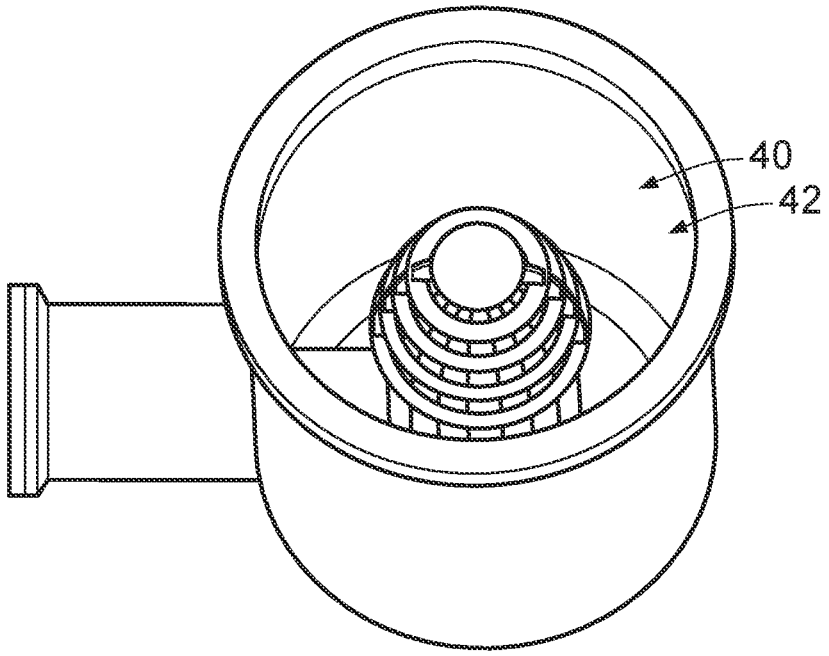
FIG. 3 shows a cryopump according to an embodiment.

FIG. 3 shows a view through the pump inlet 40. As can be seen the inner surface of the pump vessel comprises an inner element 42 which is a radiation shield. When viewed through the inlet the first stage array provides effective shielding of the second stage array from a view perpendicularly through the inlet and protects it from radiation load and from process by product contaminants. The spacing between elements in the axial direction allows access to the cryopanels for molecules with a component of velocity parallel to the inlet, such as those deflected by the radiation shield 42. Molecules deflected by the radiation shield will be predominantly type II or type III gases as the radiation shield will capture the type I gases. The lower portions of the cryopanel structure are not surrounded by the frontal array allowing easy access to this portion of the structure for molecules travelling deeper into the pump.

Figure 4:
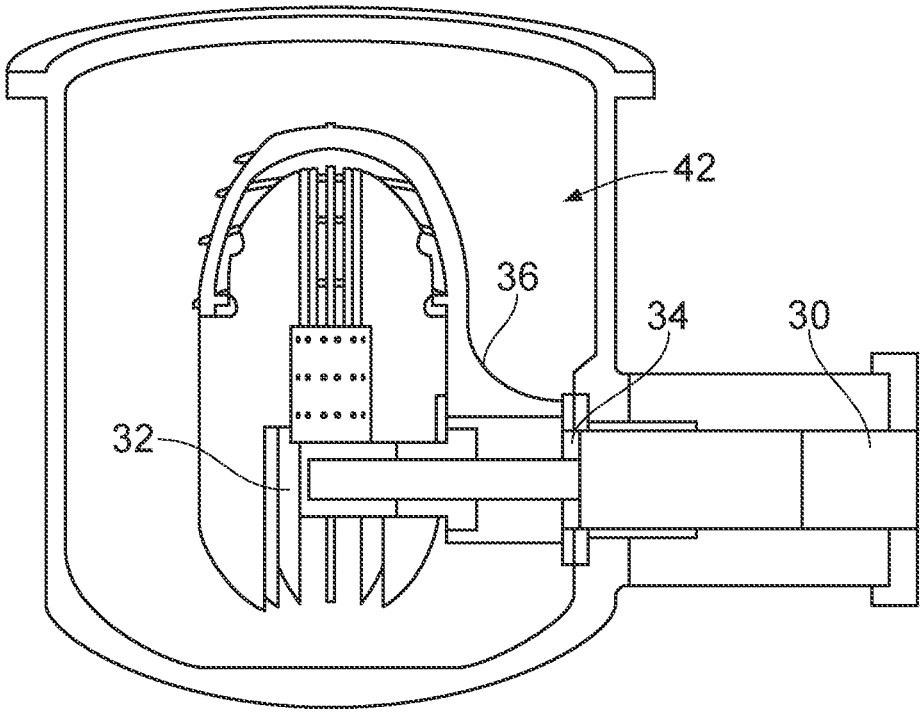
FIG. 4 shows a section through a cryopump according to an embodiment.

FIG. 4 shows a side view of the pumping vessel with a portion cut out such the interior can be viewed. As can be seen the refrigerator 30 extends into the lower portion of the pump vessel remote from the inlet and a first stage of the refrigerator element 34 is thermally connected to the radiation shield 42 and to a thermally conductive mount 36 which mounts the first stage array 10.

The thermally conductive mount 36 extends around the igloo structure contacting each of the elements in two diametrically opposed places and provides a good thermal connection between these elements and the first stage of the refrigerator element. In this way, there is a good thermal path directly from the first stage refrigerator element to each element of the first stage array allowing for the array to be retained at a cold and uniform temperature.

The second stage of the refrigerator 32 is connected to the second stage cryopanels not shown and maintains these at the lower second stage temperature. The refrigerator element 30 is located towards the base of the pump vessel and in this way any shielding of the gasses by the extension of this refrigerator element into the pump is reduced.

Figure 5:
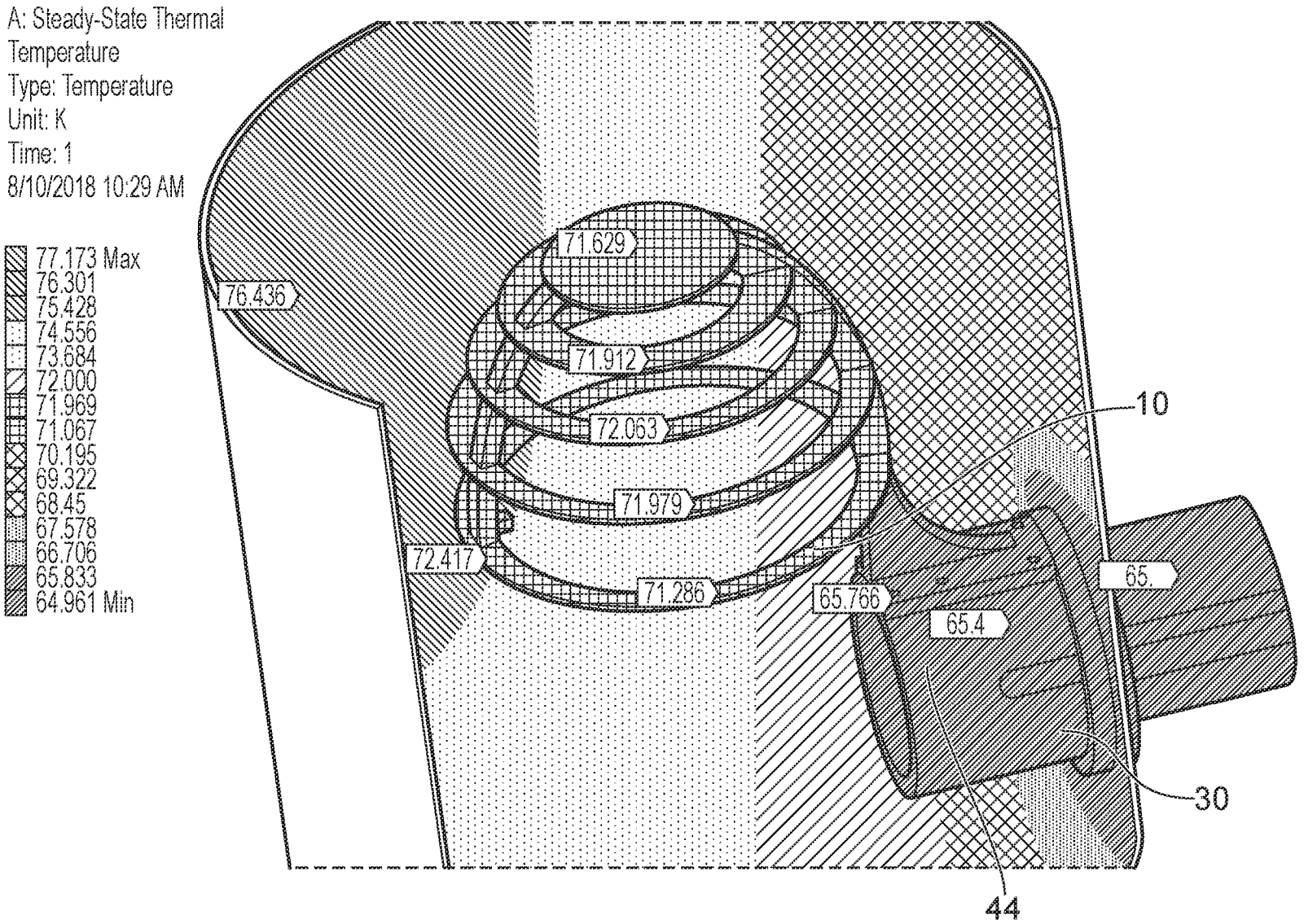
FIG. 5 shows a further cross section through a cryopump according to an embodiment.

FIG. 5 shows a cross section of the pump showing the first stage array 10, the refrigerator element 30 and how they are connected. In particular, it shows how the refrigerator element is held within the pump vessel and connects to the radiation shield. The radiation shield is flattened at this point to provide a sealed connection with the flattened flange of the refrigerator element and there is a protrusion 44 in the radiation shield above the connection that reflects this flattening and provides a surface against which molecules may impact and be deflected back towards the inlet. In this embodiment the design is such that the protrusion is decreased in size compared to a conventional cryopump and extends into the cylinder by less than 8% of the cylinder diameter, in many embodiments less than 6%. This provides less of an obstruction to gas molecules entering the pump and improves pumping speeds.

This figure shows the differences in temperature between the different portions of the first stage. The first stage refrigerator element is the coldest portion at about 65K, the first stage array is maintained at a temperature of between 71 and 72.5K, while the radiation shield is colder towards the refrigerator side, but the opposing side reaches temperatures above 75K. In conventional cryopumps where the first stage array is adjacent to the inlet, this inlet array reflects the temperature of the warmer portion of the radiation shield and is above 75K. Thus, embodiments provide a cooler first stage array of a more uniform temperature than a conventional cryopump improving capture of type I gases.

In summary with conventional cryopump designs the 2nd stage array is shielded by an inlet mounted planar radiation baffle or frontal array. This baffle is adjacent to the inlet and attached to the top of the radiation shield. As with a large umbrella, gas molecules are intercepted and bounced out of the pump before they can get close to the second stage array. The refrigerator cylinder and 1st stage mount is also conventionally higher in the pump, shielding more type II and type III molecules such as hydrogen from reaching the second stage array.

Embodiments provide by contrast a second stage array that is shielded with an inlet radiation baffle of multiple elements arranged within the pump at different distances from the inlet. This array configuration blocks fewer molecules at the inlet of the pump, allowing more molecules to arrive in a position to strike a surface of the second stage array. This design also provides improved shielding of the second stage array from type I gases resulting in lower contamination and lower second stage radiation exposure. The second stage array is combined with the first stage array shape and lower refrigerator placement to form a trinity of enhancements.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A cryopump comprising:

a vessel comprising a frontal open area, said frontal open area comprising an inlet to said vessel;

a radiation shield;

a two-stage refrigerator extending into a side wall of said vessel at a portion of said side wall remote from said inlet, said portion of said side wall being at a point closer to a closed end of said vessel than to said inlet, a first stage of said refrigerator being thermally coupled to said radiation shield;

a first stage array arranged within said vessel and thermally coupled to said first stage of said refrigerator through a mounting element extending toward the inlet from the two-stage refrigerator within the radiation shield;

a cryopanel structure coupled to a second stage of said refrigerator;

said first stage array comprising a plurality of elements arranged at increasing distances from said inlet, with an element of the plurality of elements closest to said inlet being located between said inlet and said cryopanel structure and having a smaller outer perimeter than all other elements of the plurality of elements, and each of the plurality of elements other than the element closest to said inlet having a respective passage through a central portion of the element and wherein the mounting element positions all of the elements in the plurality of elements closer to the inlet than the two-stage refrigerator is to the inlet.

2. The cryopump according to claim 1, wherein said cryopanel structure has a diameter at a widest point that is less than 70% of a diameter of said vessel.

3. The cryopump according to claim 1, wherein said refrigerator extends into said vessel at a portion of said side wall that is at a distance of at least 60% of a length of said vessel from said inlet.

4. The cryopump according to claim 1, wherein said cryopanel structure has a length that is greater than 70% of a length of said vessel.

5. The cryopump according to claim 1, wherein said said mounting element is formed of a thermally conducting material coupled to said first stage refrigerator and to each of said plurality of elements of said first stage array.

6. The cryopump according to claim 1, wherein one end of said cryopanel structure extends into said first stage array, such that at least one of said elements further from said inlet surrounds an outer perimeter of said one end of said cryopanel structure.

7. The cryopump according to claim 6, wherein said cryopanel structure comprises a plurality of panels extending out from a central axis and having a substantially cylindrical envelope with at least one tapered end, one of said at least one tapered end extending into said first stage inlet array.

8. The cryopump according to claim 7, wherein a portion of said cryopanel structure that extends into said first stage array comprises at least 20%.

9. The cryopump according to claim 1, wherein neighbouring elements of said first stage array are configured such that for at least some of said elements closest to said inlet an outer perimeter of one element is substantially equal to or smaller than an inner perimeter of a subsequent element located further from said pump inlet.

10. The cryopump according to claim 1, wherein said first stage array has a substantially igloo shape, said elements being concentric and said element closest to said inlet having a smallest perimeter, and a plurality of subsequent elements having outer perimeters of an increasing size with distance from said inlet.

11. The cryopump according to claim 1, wherein said elements are substantially planar said element closest to said inlet having a disc shape and subsequent elements comprising rings.

12. The cryopump according to claim 1, wherein said surfaces of said elements facing said inlet are at an angle of between 0° and 30° to a plane of said inlet, such that they are parallel to said plane or slanted such that a surface closest to said inlet faces towards said radiation shield.

13. The cryopump according to claim 1, wherein said element of said first stage array that is furthest from said inlet is mounted closest to said first stage of said refrigerator, a surface of said first stage array closest to said inlet being between 5 and 15% into said vessel.

14. The cryopump according to claim 13, wherein said first stage array extends from a point between 5 and 15% into said vessel to a point between 25 and 40% into said vessel.

15. The cryopump according to claim 1, wherein said radiation shield is substantially cylindrical and comprises a flattened portion extending into said cylinder for coupling to said refrigerator, said flattened portion extending into said cylinder by less than 8% of a diameter of said cylinder.

* * * * *